US005626224A

United States Patent [19]

Clark et al.

[11] Patent Number: 5,626,224

[45] Date of Patent: May 6, 1997

[54] EYEGLASS CONTAINER WITH COMPRESSING MEANS

[75] Inventors: Stewart F. Clark; K. Wade Karren, both of Salt Lake City, Utah

[73] Assignee: Glassafe, Inc., Salt Lake City, Utah

[21] Appl. No.: 566,927

[22] Filed: Dec. 4, 1995

[51] Int. Cl.[6] ..... A45C 11/04

[52] U.S. Cl. ..... 206/5

[58] Field of Search ..... 206/5, 6

[56] References Cited

U.S. PATENT DOCUMENTS

| | | | |
|---|---|---|---|
| 2,455,079 | 11/1948 | Mercer | 206/6 |
| 2,650,700 | 9/1953 | Wolf | 206/5 |
| 3,559,798 | 2/1971 | Jacobsen . | |
| 3,819,033 | 6/1974 | Hueber . | |
| 3,938,655 | 2/1976 | Romolt . | |
| 4,696,401 | 9/1987 | Wallace . | |
| 5,032,019 | 7/1991 | Burchett . | |
| 5,052,550 | 10/1991 | Pfenning . | |
| 5,188,322 | 2/1993 | Kinstrey . | |
| 5,310,048 | 5/1994 | Stechler . | |
| 5,513,744 | 5/1996 | Yabarra | 206/5 |
| 5,526,924 | 6/1996 | Klutznick | 206/5 |

FOREIGN PATENT DOCUMENTS

| | | | |
|---|---|---|---|
| 654244 | 12/1937 | Germany | 206/5 |
| 254506 | 7/1926 | United Kingdom | 206/5 |

*Primary Examiner*—Bryon P. Gehman

*Attorney, Agent, or Firm*—Workman, Nydegger & Seeley

[57] ABSTRACT

An eyeglass case is provided having a rigid tubular container with an open first end and a closed second end. The container also has an interior surface defining a housing chamber. Mounted against the interior surface is a resiliently compressible insert. A receiving slot is formed between the insert and a portion of the interior surface of the container. As glasses are received within the slot, the insert compresses so as to bias the glasses against the interior surface of the container, thereby securing the eyeglasses within the container.

27 Claims, 6 Drawing Sheets

EYEGLASS CONTAINER WITH COMPRESSING MEANS

BACKGROUND OF THE INVENTION

1. The Field of the Invention

The present invention relates to containers for holding eyeglasses and, more specifically, containers having an openly exposed access that securely hold eyeglasses.

2. The Relevant Technology

The purchase of eyeglasses, such as sunglasses and prescription glasses, can be an expensive investment often costing several hundred dollars. To obtain long lasting and functional use of a pair of eyeglasses, it is important that the glasses be properly cared for and protected. This is especially important when the glasses are not being used. Many modem eyeglasses are formed from thin, aesthetically appealing frames that can be relatively fragile. Furthermore, proper care of eyeglasses requires that the lenses be protected when not in use so as to avoid scratching of the lenses.

To protect eyeglasses when not in use, numerous different types of eyeglass cases have been developed. The most common type of eyeglass case comprises a soft, flexible pocket having an open end in which the glasses can be selectively inserted and removed. By having the case made of a soft material, the lenses are protected from being scratched. The problem with such a case, however, is that due to its flexible nature the glasses contained therein can be easily crushed or damaged. This often occurs when the case containing the eyeglasses is dropped or a heavy object is placed on the case. Furthermore, it is easy for the eyeglasses to fall out of the open access to the case.

To remedy these problems, alternative eyeglass cases have been developed. For example, rigid eyeglass cases have been designed that prevent the glasses from accidentally being crushed. Such cases often have a soft liner to prevent the lenses from getting scratched. Furthermore, rigid cases typically come with a closure that prevents the eyeglasses from falling out of the case. The closure typically comprises a hinged flap having some form of fastening assembly such a hook or button that keeps the flap closed over the opening of the case.

The problem with conventional rigid cases, however, is that they are often inconvenient to use. For example, the presence of the closure flap and fastener can make it difficult to quickly remove or replaces the eyeglasses while performing other activities such as driving. The hinges and fastener are also relatively easily broken and can significantly increase the cost of the case. Another problem with rigid eyeglass cases is that they are generally designed to fit only a single style of eyeglass. Therefore, it is often difficult to exchange or store different eyeglasses using the same case.

Other problems generally applicable to all conventional eyeglass cases is that they are designed to lay flat. As such, eyeglass cases are often difficult to see or locate when placed on high shelves. Furthermore, having that the eyeglass case lay flat takes up more room on the surface they are being stored and makes the case more susceptible to having objects set thereon. Finally, another problem encountered with most conventional eyeglass cases is that they sink in water. This is often a problem to water skiers, sailors, and other boaters who often use glasses around the water.

OBJECTS AND BRIEF SUMMARY OF THE INVENTION

Accordingly, it is therefore an object of the present invention to provide improved eyeglass containers for holding eyeglasses.

It is another object of the present invention to provide improved eyeglass containers that are rigid to prevent crushing of the eyeglasses contained therein.

Still another object of the present invention is to provide improved eyeglass containers as disclosed above wherein the containers are continuously open to allow easy receiving and removal of the eyeglasses therein.

Yet another object of the present is to provide improved eyeglass containers as disclosed above wherein the open, rigid containers securely hold a pair of eyeglasses without the use of a closure flap.

It is another object of the present invention to provide improved eyeglass containers as disclosed above wherein the open, rigid containers securely hold a pair of eyeglasses without the use of hinges or conventional fasteners.

Another object of the present invention is to provide improved eyeglass containers wherein a single container can securely hold a variety of different styles of eyeglasses.

Also another object of the present invention is to provide improved eyeglass containers that can be vertically stored on a flat surface.

Finally, another object of the present invention is to provide improved eyeglass containers that float when submersed in water.

In order to achieve the foregoing objectives and in accordance with the invention as broadly disclosed and claimed herein, a case for holding eyeglasses is provided. The case comprises a rigid unitary tubular container having a first end and an opposing second end. The container further includes an interior surface defining a holding chamber. The interior surface is defined in part by a first wall, an opposing second wall, and curved side walls. An annular lip is formed at the first end of the container and defines an opening to the holding chamber. A base member is positioned at the second end of the container so as to close off the second end. The base member is preferably flat to enable the container to vertically stand thereon.

Longitudinally positioned against the first wall on the interior surface of the container is a retaining insert. A receiving slot is formed between the retaining insert and the second wall of the interior surface of the container. In the preferred embodiment, the retaining insert comprises a resiliently compressible pad having a top end, a bottom end, and opposing sides extending therebetween. A thin, soft covering is folded over the top end of the pad and secured to the opposing sides of the pad.

In this embodiment, eyeglasses can be positioned within the receiving slot between the retaining insert and the second wall of the container. The glasses are positioned so that the lenses are in direct contact with the thin, soft covering so as not to scratch the lenses. As the glasses are positioned within the receiving slot, the resilient insert is compressed so as to snugly receive the eyeglasses. In ram, the compressed insert provides a force which urges the eyeglasses against the second wall of the interior surface so as to secure the glasses within the receiving slot without the need for a cap or any other kind of restraining means.

The inventive eyeglass case has several advantages over conventional cases. For example, since the container is continually open, it is easy to insert or remove the eyeglasses. Furthermore, as there are no moving parts, the container is not easily broken. As a result of the insert being compressible, a variety of different styles of eyeglasses can be positioned within the container. Finally, by making the insert out of a foamed material, the case will float when containing relatively light weight glasses.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be understood, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
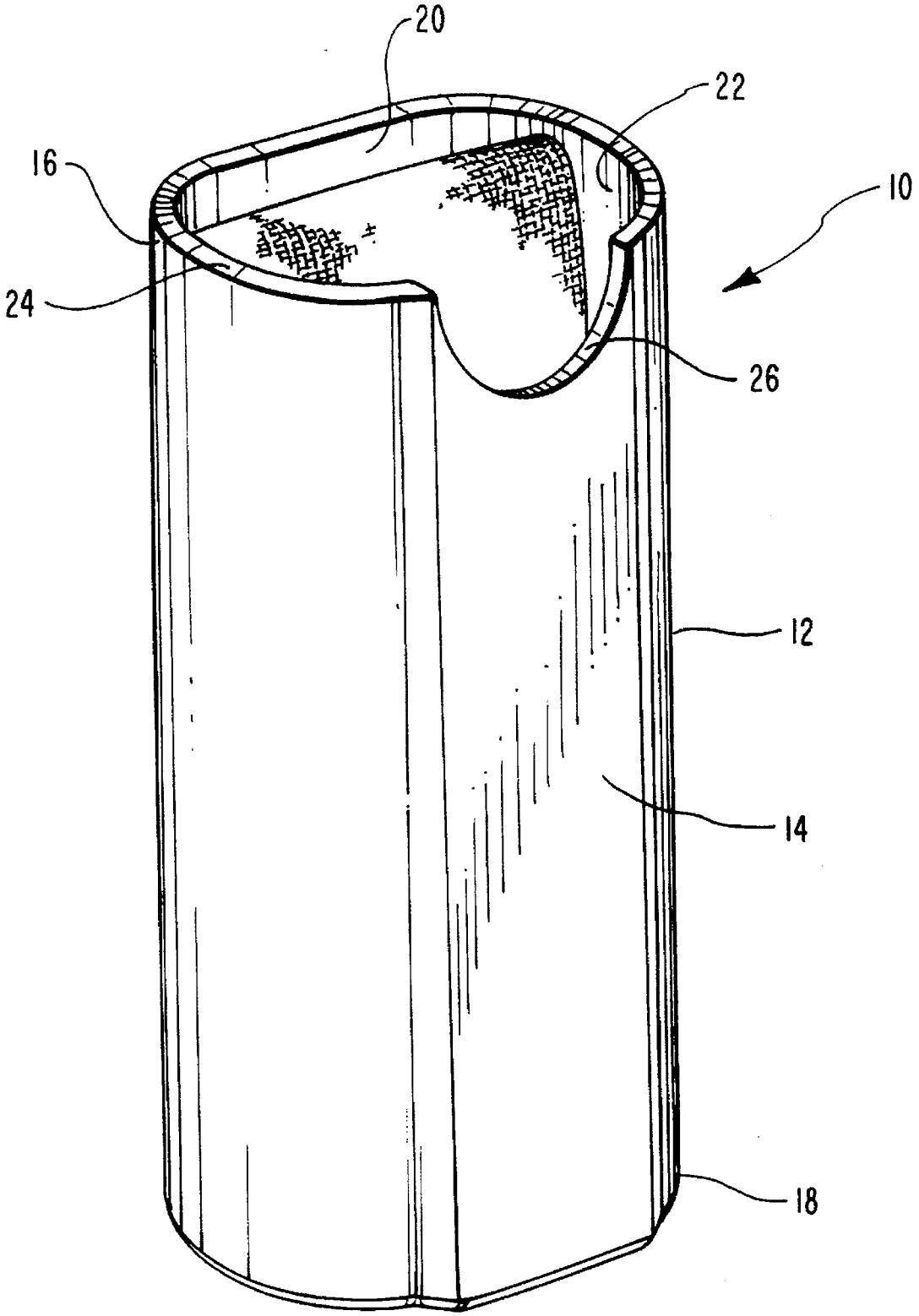
FIG. 1 is a front perspective view of an eyeglass container showing an open first end.

Depicted in FIG. 1 is one embodiment of an inventive eyeglass case 10 used for holding eyeglasses. The term "eyeglasses" as used in the specification and appended claims is intended to include all styles and kinds of eyeglasses. By way of example and not by limitation, case 10 can be used for holding sunglasses, prescription glasses, and protective glasses. Case 10 is shown in FIG. 1 as comprising a rigid unitary tubular container 12 having an exterior surface 14 extending between a first end 16 and an opposing second end 18. Exterior surface 14 has an outside diameter preferably sized to allow container 12 to fit within a conventional sized cup holder, such as the cup holders incorporated into automobiles.

Container 12 is also shown as having an interior surface 20 that also extends between first end 16 and second end 18. Interior surface 20 defines a holding chamber 22 within container 12. Positioned at first end 16 is an annular lip 24 that defines an opening to holding chamber 22. As shown in FIG. 1, container 12 further includes a recessed groove 26 positioned at annular lip 24 and extending a distance towards second end 18. Recessed groove 26 provides greater access to holding chamber 22 for receiving and removing eyeglasses therefrom.

In the preferred embodiment, container 12 is formed as a single unit using convention injection molding processes. Alternatively, other molding process, such as die casting or blow molding, can also be used. Furthermore, container 12 can be formed in separate parts which are later assembled together. Container 12 is preferably formed of polypropylene. There are, of course, a variety of different materials that can also be used. By way of example and not by limitation, container 12 can be formed from metals, composites, fiberglass, wood, or other plastics such as polystyrene.

Figure 2:
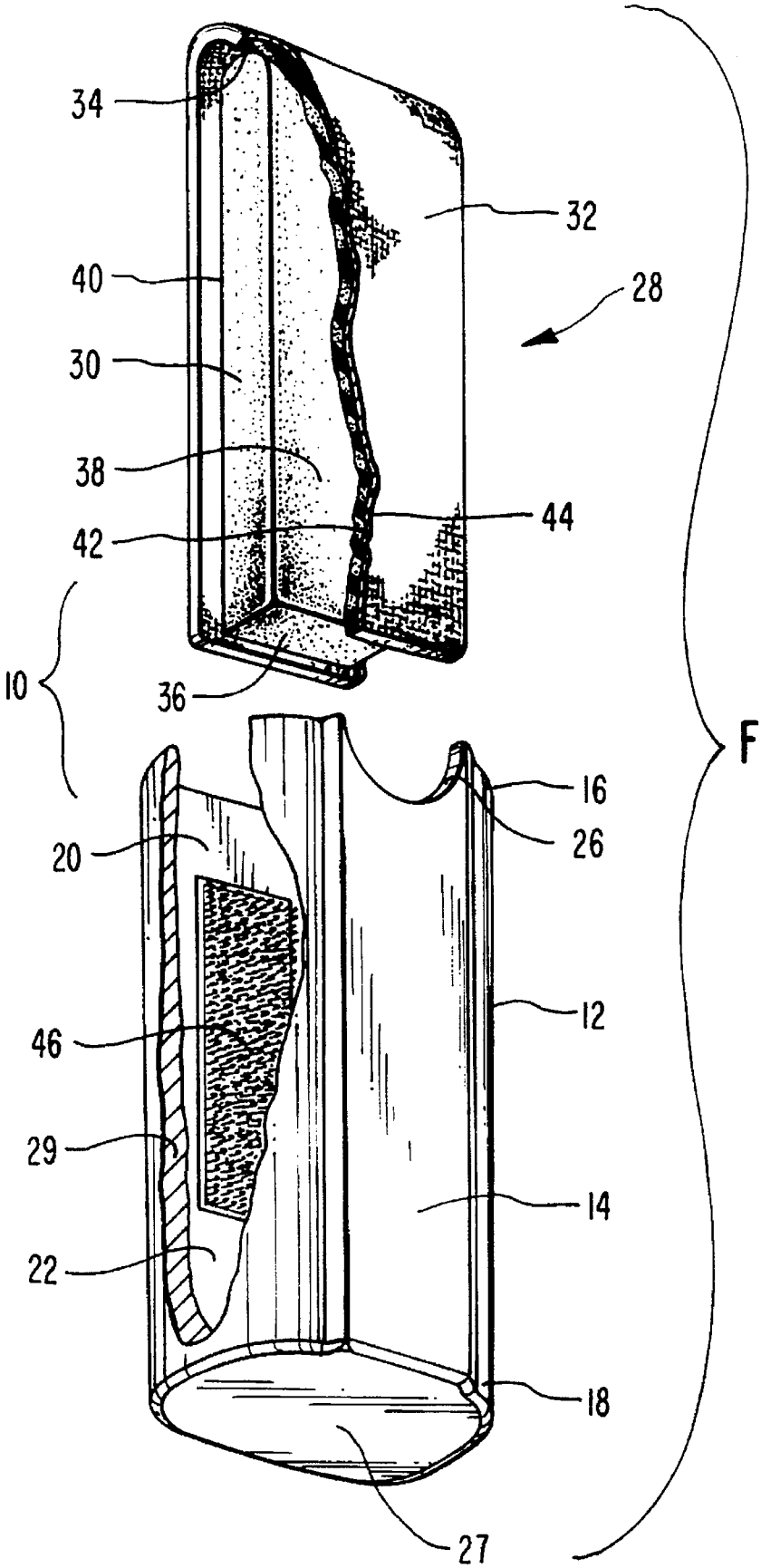
FIG. 2 is a partially exploded view of the container of FIG. 1 having an insert being removed from the container, the container being partially cut away to disclose means for holding the insert within the container.

Positioned at second end 18, as depicted in FIG. 2, is a base member 27 that closes off access to holding chamber 22. Base member 27 is substantially flat and configured so as to enable container 12 to vertically stand on base member 27. FIG. 2 also discloses container 12 as being formed of a wall 29 having a thickness that increases from first end 16 to second end 18. By having the thickness minimized at top end 16, container 12 has increased flexibility at top end 16 for increased ease in insertion and removal of the glasses.

In one embodiment of the present invention, means are positioned within holding chamber 22 for compressing eyeglasses received within holding chamber 22 to hold the eyeglasses within container 12. By way of example and not by limitation, depicted in FIG. 2 is a partially exploded view of eyeglass case 10 showing an elongated insert 28 that is housed within holding chamber 22. Insert 28 is shown as comprising a compression pad 30 partially encased by a cover 32. Compression pad 30 has an elongated substantially rectangular configuration defined in part by a top end 34 and an opposing bottom end 36. A first face 38 and an opposing second face 40 extend between the opposing ends 34 and 36. Pad 30 is made of a resiliently compressible material such as an open cell ester based foam or an ether based foam.

Cover 32 comprises an interior surface 42 made of a resiliently compressible material such as that used for pad 30 and an exterior surface 44 made of a soft scratch resistance material. In the preferred embodiment, cover 32 is made of a heat laminated foam having brushed nylon attached thereto as exterior surface 44. Cover 32 is folded around top end 34 of pad 30 so that interior surface 42 is positioned against first face 38 and second face 40. Cover 32 is preferably secured to pad 30 by an adhesive or tape. For use with conventional sized eyeglasses, pad 30 typically has a thickness in a range between about 0.5 inches to about 0.7 inches while cover 32 typically has a thickness in a range between about 0.1 inches to about 0.2 inches. It is noted, however, that all dimensions and sizes disclosed herein are only by way of example and not intended to be limiting. In alternative embodiments, the sizes and dimensions can be proportionally altered to accommodate uniquely configured eyeglasses.

Figure 3:
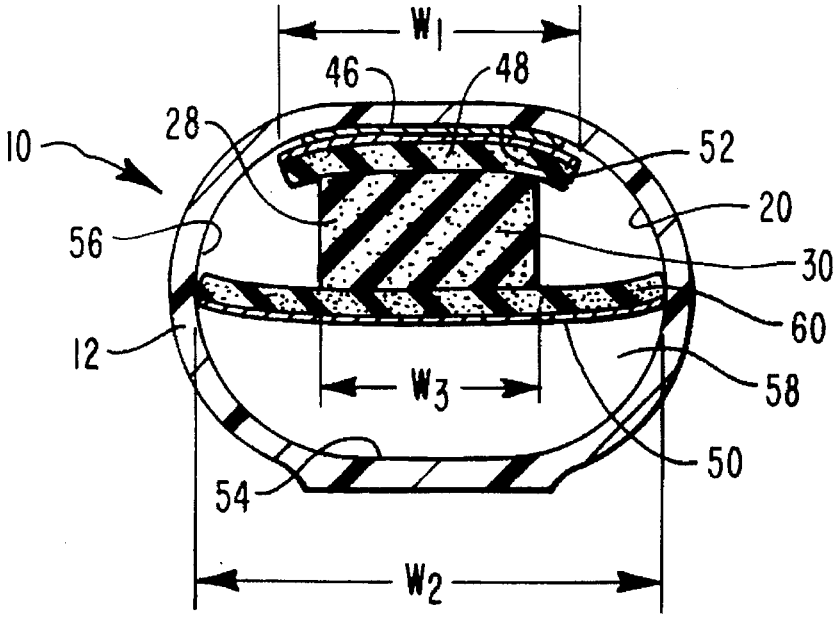
FIG. 3 is a cross-sectional view of the eyeglass container of FIG. 1 showing the insert positioned therein.

Depicted in FIG. 3 is a cross-sectional view of container 12 having insert 28 received therein. Interior surface 20 of container 12 is shown in FIG. 3 as being substantially oval shaped and defined by a substantially flat first wall 52, opposing substantially flat second wall 54, and curved sidewalls 56. Insert 28 is shown positioned against first wall 52.

In one embodiment of the present invention, means are provided for securing retaining insert 28 to interior surface 20. By way of example and not by limitation, FIGS. 2 and 3 disclose a VELCRO® strap 46 secured to first wall 52 of interior surface 20. VELCRO® securely binds to brushed nylon. Accordingly, by forming exterior surface 44 of cover 32 out of brushed nylon, Velcro® strap 46 allows for repeated removal and attachment of retaining insert 28 within holding chamber 22. In alternative embodiments, insert 28 can be attached by glues, adhesives, tape, or any other conventional type of attachment structure or material.

By securing retaining insert 28 against first wall 52, a receiving slot 58 is formed between retaining insert 28 and second wall 54. During use, folded eyeglasses are slid within receiving slot 58 through the opening at first end 16. Eyeglasses are oriented within receiving slot 58 so that the lenses of the glasses are positioned against cover 32 to prevent the lenses from getting scratched. In the preferred embodiment, the distance between retaining insert 28 and second wall 54 is in a range between about 0.5 inches to about 0.8 inches with about 0.6 inches to about 0.7 inches being preferred. More specifically, the distance between retaining insert 28 and second wall 54 is slightly smaller than the thickness of folded eyeglasses. As such, as the glasses are received within receiving slot 58, insert 28 compresses. As a result of the resiliency of insert 28, however, insert 28 continuously urges the glasses against second wall 54 so as to securely hold the eyeglasses within receiving slot 58. In light of the fact that insert 28 is compressible, a variety of different size, shapes, and styles of glasses can be securely received within receiving slot 58. In alternative embodiments, different sizes of container 12 can be formed to hold different sizes of glasses.

FIG. 3 also depicts cover 32 as comprising a narrow portion 48 having a width $W_1$ and begin secured to second face 40 of pad 30. Cover 32 also has a wide portion 50 having a width $W_2$ that is greater than width $W_1$. Wide portion 50 is secured to first face 38 of pad 30. As also shown in FIG. 3, pad 30 has a width $W_3$ that is smaller than width $W_2$ of wide portion 50.

Width $W_2$ of wide portion 50 is preferably slightly larger than the distance between side walls 56. This insures that the lenses of the glasses will be completely covered and protected by cover 32. By having width $W_3$ of compression pad 30 smaller than width $W_2$ of wide portion 50, wide portion 50 comprises flexible arms 60 that project to the sides of pad 30 an can fold back towards pad 30. Flexible arms 60 provide extra room for receiving glasses having long ear pieces, wide curved lenses, or other features that would compress against flexible arms 60.

The above disclosed configuration of retaining insert 28 is only one embodiment of means positioned within holding chamber 22 for compressing eyeglasses received within holding chamber 22 to hold the eyeglasses within container 12. In alternative embodiments, the configuration and size of pad 30 and cover 32 can be altered. For example, pad 30 can be as wide as wide portion 50 of cover 32. Furthermore, cover 32 can be positioned over only a portion of pad 30 or over all of pad 30. In other embodiments, the means can be limited to only pad 30. That is, cover 32 is not necessarily required. Finally, in yet other embodiments, the means can comprise other conventional types of structures that have resiliently compressible properties, for example, different padded spring structures can be used. Alternatively, a water or air inflated bladder could be inserted within container 12.

Figure 3A:
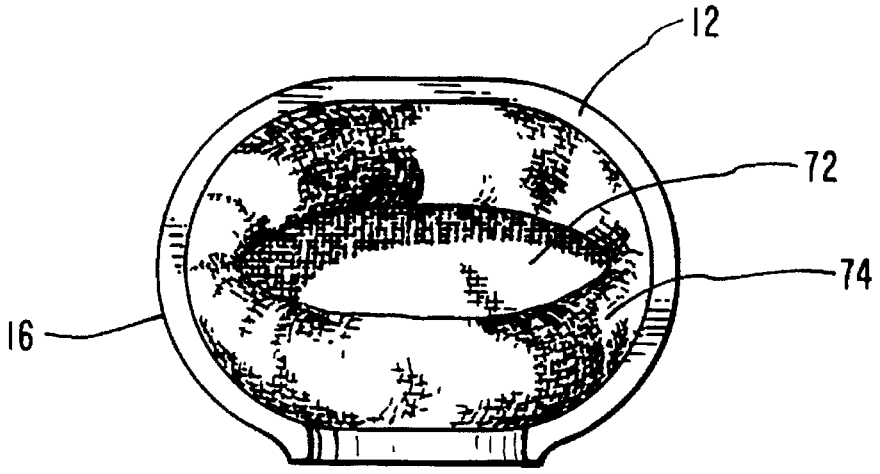
FIG. 3A is an end view of the eyeglass container of FIG. 1 having an insert disposed around the interior surface of the container.

Compressing the eyeglasses can be accomplished by either compressing the eyeglasses against the interior surface of container 12, as discussed above, or by positioning an item within container 12 that independently compresses the eyeglasses. For example, as disclosed in FIG. 3A, another embodiment for means positioned within holding chamber 22 for compressing eyeglasses received within holding chamber 22 comprises a resiliently compressible retaining insert 74 that is completely disposed around interior surface 12 so as to define a receiving slot 72. In this embodiment, as folded glasses are positioned within receiving slot 72, retaining insert compresses against the glasses on opposing sides to snugly hold the glasses within receiving slot 72. Using the same teachings, compressible inserts could be selectively positioned at different locations on interior surface 20 to snugly hold glasses within container 12.

Figure 6:
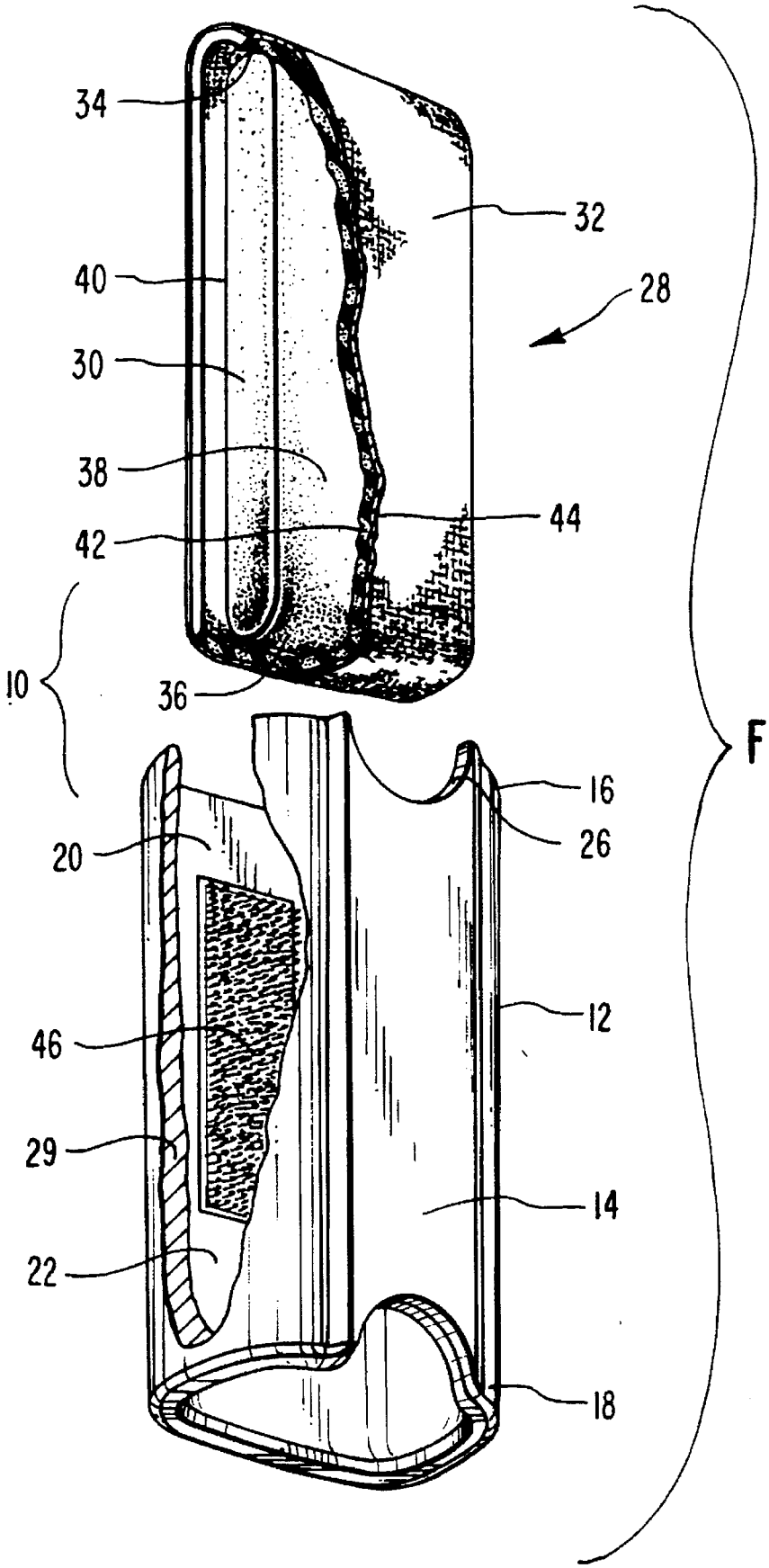
FIG. 6 is a partially exploded view of an alternate container having an insert being removed from the container, the container being partially cut away to disclose means for holding the insert within the container, the container having an open second end.

Since independent means are provided for holding the glasses within container 12, in an alternative embodiment, as shown in FIG. 6, base member 27 can be removed so that an opening is formed at second end 18 in substantially the same manner that an opening is formed at first end 16. In this embodiment, the eyeglasses can be inserted into holding chamber 22 from either first end 16 or second end 18.

Figure 4:
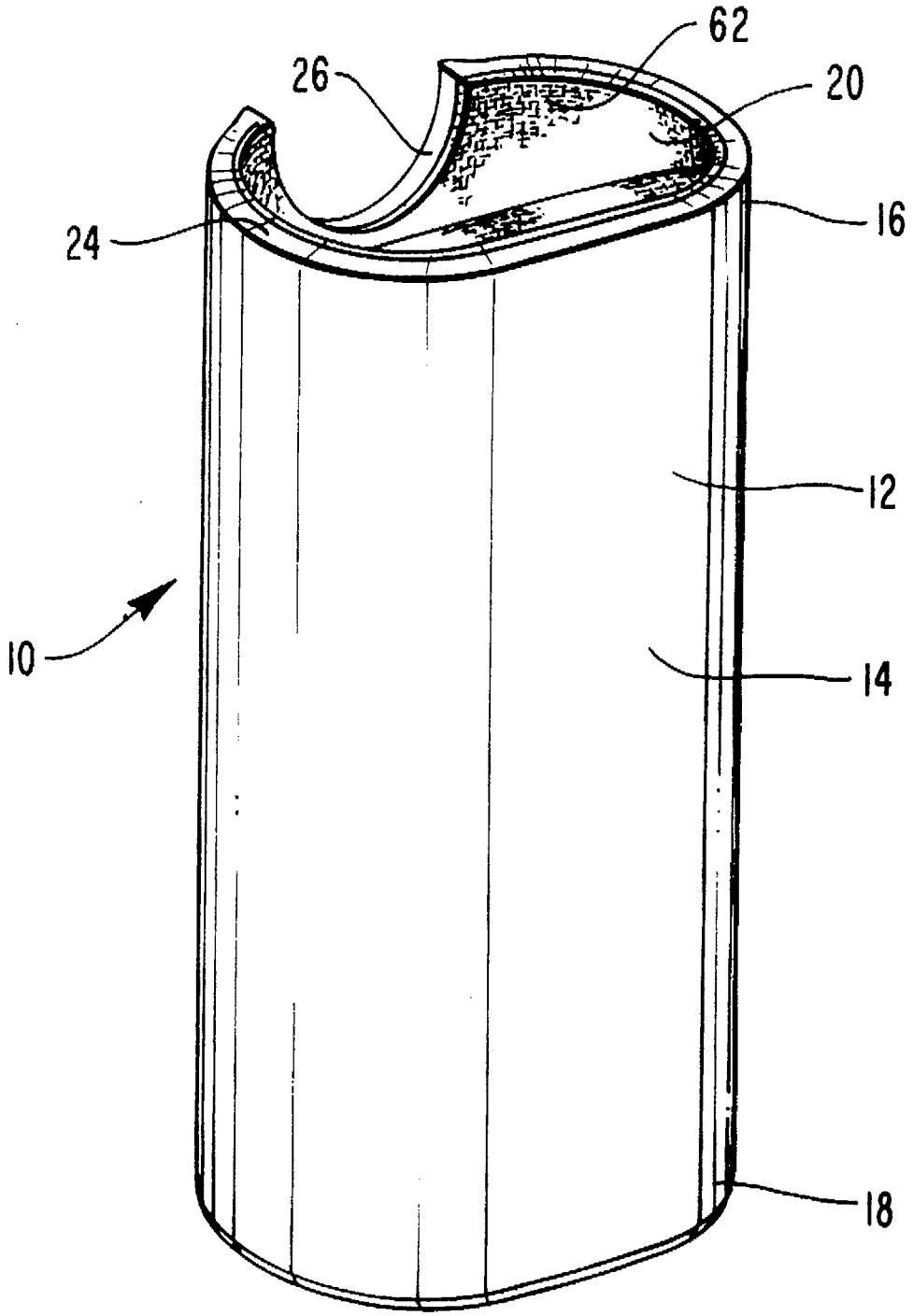
FIG. 4 is a back perspective view of an alternative eyeglass container showing a lining positioned on the interior surface of the container.

In one embodiment, as shown in FIG. 4, interior surface 20 can be lined with a soft cushioning material 62 such as felt, silk, or the like. Cushioning material 62 helps to further protect the frame and other structures of the glasses.

Figure 5:
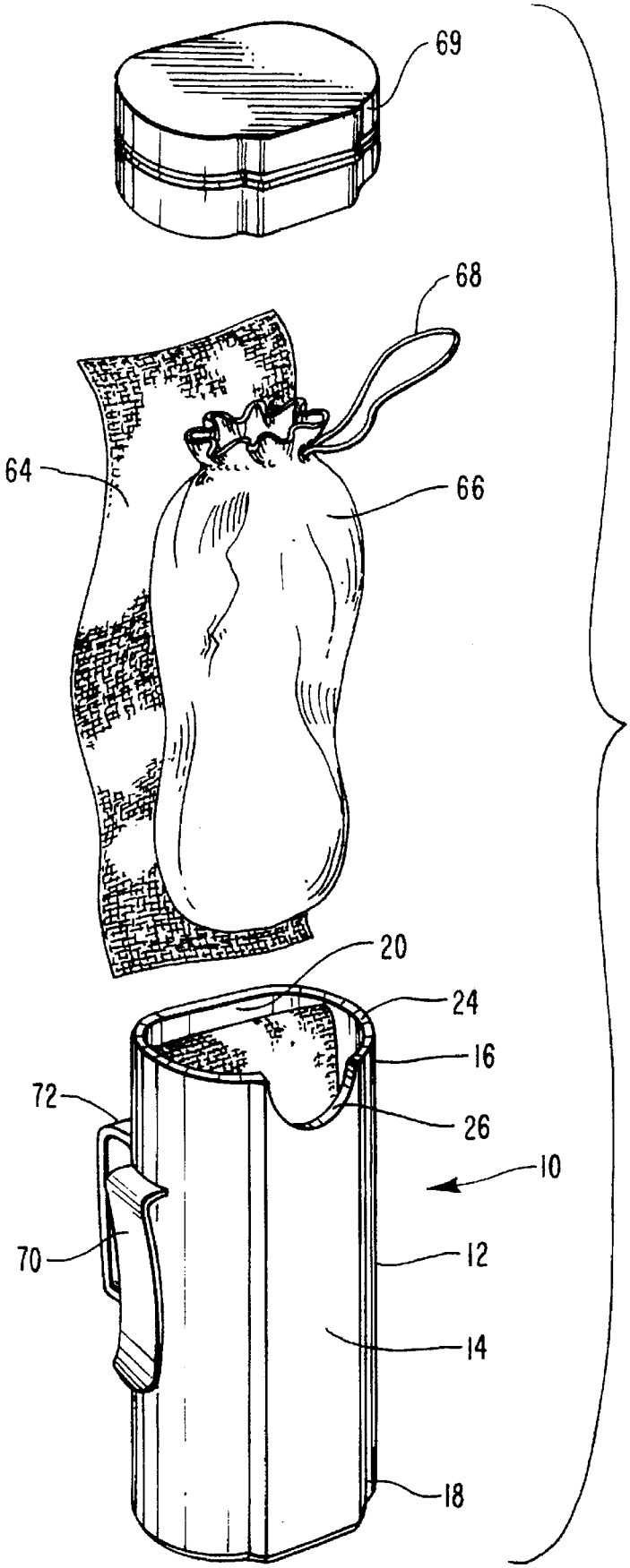
FIG. 5 is a partially exploded perspective view of an alternative embodiment of an eyeglass container that can be used with a polishing chamois, an eyeglass bag, and a cap.

In another alternative embodiments of eyeglass case 10, as depicted in FIG. 5, a cleaning cloth 64 can be positioned within holding chamber 22 to allow selective cleaning of the lenses of the glasses. Cleaning cloth 64 can be made out of a chamois or other soft material commonly known to those in the art. A holding bag 66 can also initially be used for receiving the glasses prior to positioning the glasses within receiving slot 58. Bag 66 preferably has a draw string 68 or other means for closing the bag so as to prevent dirt, sand, or other debris from coming in contact with the glasses.

Although insert 21 secures the eyeglasses within chamber 22, a cap 69 can also be used for sealing off first end 16 of container 12. Cap 69 is thus useful in preventing sand, dirt, or other debris from entering into holding chamber 22 and possible scratching the lenses of the eyeglasses. Furthermore, by using cap 69, chamber 22 can be sealed from water, thereby making tubular container 12 buoyant when immersed in water.

The present invention also provides means for attaching container 12 to an independent object. By way of example and not by limitation, FIG. 5 discloses exterior surface 14 of container 12 having a mounting clip 70 secured thereto. Alternatively, a loop 72 is also shown attached to exterior surface 14 so as to enable attachment of the container 12 to a belt or other kind of strap.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A case for holding eyeglasses comprising:

(a) a rigid unitary tubular container having:

(i) a continuously open end;

(ii) a closed end; and (iii) an interior surface extending between the open end and the closed end, the interior surface defining a holding chamber for receiving the eyeglasses; and (b) means positioned within the holding chamber for compressing the eyeglasses received within the holding chamber against said interior surface to snugly hold the eyeglasses within the holding chamber, the compressing means permitting convenient insertion and removal of the eyeglasses through the continuously open end.

2. A case as recited in claim 1, further comprising a substantially flat base member positioned at the closed end of the container to allow the container to vertically stand on the base member.

3. A case as recited in claim 1, wherein the container is made from polypropylene.

4. A case as recited in claim 1, further comprising an annular lip formed at the continuously open end and defining an opening to the holding chamber, the annular lip having a recessed groove extending towards the closed end of the container.

5. A case as recited in claim 1, wherein the container has an outside wall having a thickness that increases from the open end to the closed end.

6. A case as recited in claim 1, wherein the means for compressing the eyeglasses comprises an elongated, resiliently compressible retaining insert positioned substantially parallel to a longitudinal axis of the container against a portion of the interior surface of the container to form a receiving slot between the retaining insert and the interior surface, thereby distributing compression along the length of the eyeglasses.

7. A case as recited in claim 6, wherein the retaining insert comprises:

(a) a resiliently compressible pad having opposing top and bottom ends and opposing first and second sides; and (b) a thin soft covering folded over the top end of the pad and secured to the opposing first and second sides of the pad.

8. A case as recited in claim 6, further comprising means for securing the retaining insert to the interior surface of the container.

9. A case as recited in claim 8, wherein the means for securing the retaining insert comprises a strap secured to the interior surface.

10. A case as recited in claim 1, wherein the means for compressing the eyeglasses comprises an elongated, resiliently compressible retaining insert longitudinally positioned against the interior surface of the container to form a receiving slot substantially defined by the retaining insert.

11. A case as recited in claim 1, further comprising means for attaching the container to an independent object.

12. A case as recited in claim 11, wherein the means for attaching the container comprises the container having an exterior surface and a clip being mounted on the exterior surface.

13. A case as recited in claim 1, further comprising a cap configured to removably cover the open end of the container.

14. A case as recited in claim 1, further comprising a liner secured to the interior surface of the container.

15. A case as recited in claim 1, further comprising a polishing cloth removably housed within the container.

16. A case as recited in claim 1, further comprising a selectively closable bag configured to be positioned within the holding chamber after receiving the eyeglasses within the bag.

17. A case for holding eyeglasses comprising:

(a) a rigid tubular container having a first end and an opposing second end, and a longitudinal axis, the container further comprising:

(i) an interior surface defining a holding chamber for receiving the eyeglasses, the interior surface being defined in part by a first wall and an opposing second wall; and (ii) an annular lip formed at the first end and defining a continuous opening to the holding chamber; and (b) an elongated, resiliently compressible retaining insert positioned substantially parallel to the longitudinal axis of the container against the first wall on the interior surface of the container to form a receiving slot between the retaining insert and the second wall of the container, the retaining insert holding the eyeglasses snugly within the receiving slot, despite the continuously open end, yet permitting convenient insertion and removal of the eyeglasses; and (c) means for securing the retaining insert to the first wall.

18. A case as recited in claim 17, wherein the retaining insert comprises:

(a) a resiliently compressible pad having opposing top and bottom ends, opposing first and second sides, and a maximum width; and (b) a thin soft covering secured to a portion of at least one of the sides, the covering having a maximum width larger than the maximum width of the pad.

19. A case as recited in claim 18, wherein the covering is folded over the top end of the pad to cover at least a portion of both the first and second side of the pad.

20. A case as recited in claim 17, wherein the means for securing the retaining insert comprises a strap secured to the first wall, the strap being removably attachable to the retaining insert.

21. A case as recited in claim 17, further comprising the container having an exterior surface and a clip being mounted on the exterior surface.

22. A case as recited in claim 17, further comprising a cap configured to removably cover the first end of the container.

23. A case as recited in claim 17, further comprising a liner secured to the interior surface of the container.

24. A case for holding eyeglasses comprising:

(a) a rigid unitary tubular container having:

(i) a continuously opened first end;

(ii) an opposing second end;

(iii) a longitudinal axis; and (iv) an interior surface defining a holding chamber for receiving the eyeglasses, the interior surface extending between the first end and the second end; and (b) a compressible pad positioned substantially parallel to the longitudinal axis of the container within the holding chamber for biasing the eyeglasses against the interior surface of the container to snugly, selectively hold the eyeglasses within the holding chamber, the pad selectively compressed upon the movement of the eyeglasses into the holding chamber, the pad thereby permitting convenient insertion and removal of the eyeglasses through the continuously opened first end.

25. A case as recited in claim 24, wherein the second end is open for convenient insertion of the eyeglasses through the second end.

26. A case as recited in claim 24, wherein a base member is positioned at the second end to close the second end of the container.

27. A case for holding eyeglasses comprising:

(a) a rigid tubular container having a first end and an opposing second end, the container further comprising:

(i) an interior surface defining a holding chamber having a maximum inner diameter, the interior surface being defined in part by a first wall and an opposing second wall;

(ii) an annular lip formed at the first end and defining an opening to the holding chamber; and (iii) a base member positioned at the second end;

(b) a retaining insert positioned within the holding chamber and comprising:

(i) a resiliently compressible pad having opposing top and bottom ends, opposing first and second sides, and a maximum width; and (ii) a thin soft covering folded over the top end of the pad, the covering comprising:

(A) a wide portion secured to at least a portion of the second side of the pad and having a width greater than the maximum width of the pad; and (B) a narrow portion secured to at least a portion of the first side of the pad and also being secured to the first wall on the interior surface so that a receiving slot is formed between the wide portion of the cover and the second wall of the interior surface.

* * * * *

UNITED STATES PATENT AND TRADEMARK OFFICE

CERTIFICATE OF CORRECTION

PATENT NO. : 5,626,224

DATED : May 6, 1997

INVENTOR(S) : Stewart F. Clark;
K. Wade Karren

It is certified that error appears in the above-identified patent and that said Letters Patent is hereby corrected as shown below:

Col. 1, line 16, "modem" should be --modern--

Col. 1, line 40, "such a" should be --such as a--

Col. 1, line 45, "replaces" should be --replace--

Col. 2, line 54, "ram," should be --turn,--

Col. 5, line 40, "an" should be --and--

Col. 6, line 30, "insert 21" should be --insert 28--

Col. 6, line 34, "possible" should be --possibly--

Signed and Sealed this

Seventeenth Day of February, 1998

*Attest:*

Bruce Lehman

BRUCE LEHMAN

*Attesting Officer*

*Commissioner of Patents and Trademarks*